United States Patent [19]

Diaz

[11] Patent Number: 5,005,219

[45] Date of Patent: Apr. 9, 1991

[54] GARMENT DECORATION WITH A PROCESS FOR ITS MANUFACTURE

[75] Inventor: David P. Diaz, New York, N.Y.

[73] Assignee: Stephen S. Fleming, Irving, Tex.

[21] Appl. No.: 501,878

[22] Filed: Mar. 30, 1990

[51] Int. Cl.[5] ..... A41D 27/08

[52] U.S. Cl. ..... 2/244; 2/246; 112/400; 112/439; 112/266.1; 112/262.1

[58] Field of Search ..... 2/244, 246; 112/439, 112/266.1; 28/144; 101/114, 129

[56] References Cited

U.S. PATENT DOCUMENTS

| | | | |
|---|---|---|---|
| 151,055 | 9/1948 | McLaughlin . | |
| 2,120,687 | 6/1938 | Tarson | 2/244 |
| 4,089,722 | 5/1978 | Holoubek | 2/246 |
| 4,103,634 | 8/1978 | Schachter | 112/266.1 |

FOREIGN PATENT DOCUMENTS

| | | | |
|---|---|---|---|
| 25185 | 2/1930 | Australia | 112/266 |
| 466488 | 11/1935 | United Kingdom | 2/244 |

OTHER PUBLICATIONS

Crisa Falconer, "Team Lettering", The Sporting Goods Dealer (U.S.A. 1988).

*Primary Examiner*—Werner H. Schroeder
*Assistant Examiner*—Gloria Hale
*Attorney, Agent, or Firm*—James Creighton Wray

[57] ABSTRACT

A new garment decoration and a process for its manufacture, which encompasses both classical and modern elements of decoration. An image is manufactured directly on a garment, such as by silk-screening. Chenille is sewn about the border of the image, thereby creating a shape with a chenille outline and an interior image. The decorative shapes can be letters, numbers, mascots, characters or symbols.

14 Claims, 2 Drawing Sheets

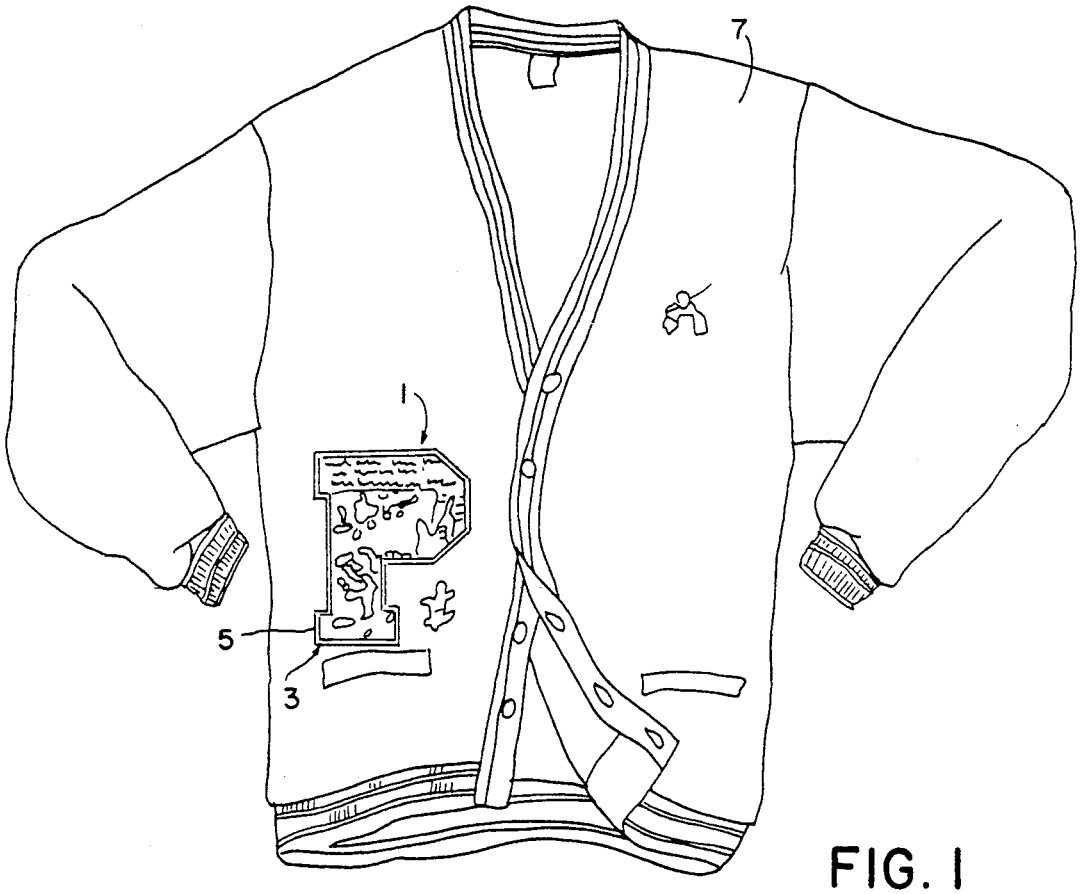
FIG. 1
FIG. 2
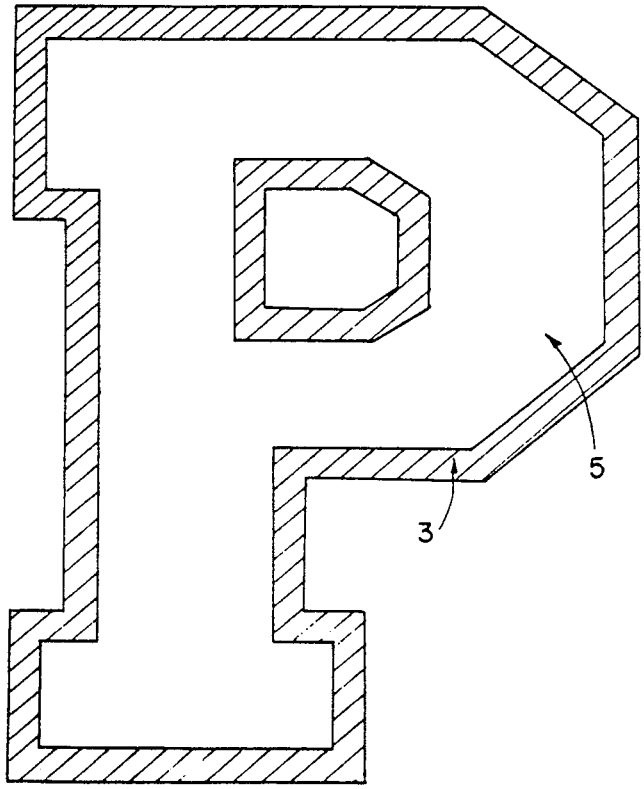

GARMENT DECORATION WITH A PROCESS FOR ITS MANUFACTURE

BACKGROUND OF THE INVENTION

Garment decoration and personalization is a large, well established industry. Many traditional means for decorating and personalizing various types of garments have existed independently for quite some time.

Letters are a classical object of decoration found on school "letter jackets". The letter decoration is manufactured by weaving colored yarn (chenille) upon a base of felt in the solid area of the letter. The letter shape is then cut from the base fabric. This decoration is then sewn onto the garment. The resulting effect is the appearance of a colored letter upon the garment with an outline of felt around the letter.

Numbers are a common decoration on athletic uniforms, such as baseball and football jerseys. Shapes of school mascots or school symbols are also commonly found on jackets and jerseys.

Another common modern object of decoration involves placing images upon a garment; such as a tee shirt. Silk-screening is a popular manufacturing process used to create this type of decoration.

Heat sealing is another popular process used to create garment image decorations.

Machinery is now available which can produce chenille directly on a garment. These machines have been used to print manufacturers' names on garments.

SUMMARY OF THE INVENTION

This invention provides a decoration with the following:

A symbol, shape or alphanumeric character composed of:

an outline area; and an interior area.

The interior area of the shape is filled with an image.

The outline area of the shape is defined with chenille. The chenille area may optionally include different colors or patterns of chenille. In particular, the chenille area may optionally be bordered with chenille of a different color.

An embodiment of the present invention is a decoration that uniquely combines the classical elements of the school letter with the modern elements of images on garments. The classical school letter decoration is often associated with athletics. When athletics-related images are used in this invention, the decoration directly portrays this association in a manner not present in the classical decoration. The use of images that are classical/historic in their own right can further add to the classical elements present in this new decoration. An example would be the use of historic football images. This decoration similarly encompasses elements of numbers on athletic garments.

It is not possible to manufacture this decoration by adding an image decoration on top of a classic letter decoration. As previously mentioned, existing image decoration manufacturing processes do not work well with the loose weave chenille material. These processes also perform poorly with the felt base material used for the classic letter decoration.

The following invention provides a new process for manufacturing this decoration which circumvents the indicated manufacturing problems.

1. Manufacture the base garment.
2. Prior to the chenilling step, manufacture an image upon the garment in the interior area where the completed decoration is located.
3. Chenille directly onto the garment only within the outline area of the decoration, rather than throughout the entire decoration.

As stated above, a preferred method for manufacturing this invention involves chenilling directly around an image on a garment. A less efficient but entirely feasible method would involve chenilling onto a felt base as is commonly done with traditional lettering, cutting the felt into the desired outline shape, and then sewing the outline around an image on a garment. The felt base would leave a thin border around the chenille and would slightly raise the outline shape.

Note that it is necessary to perform the image manufacturing step prior to the chenilling step because the added bulk of the chenille on top of the garment makes it impossible to use common imaging processes. These imaging processes require a screen or a hot press to be placed directly upon the fabric. The bulk of chenille upon the fabric prevents this.

There is a developing trend toward specialized, custom designs for garment decoration.

It is an object of this invention to satisfy the current demand and the anticipated increased demand for unique and novel garment decoration.

It is an object of the present invention to provide a source of pride and identity through a new and unique decorative design style.

It is another object of this invention to combine classic forms of garment decoration in a new and unobvious way.

These and further and other objects and features of the invention are apparent in the disclosure, which includes the above and ongoing written specification, with the claims and the drawings.

BRIEF DESCRIPTION OF THE DRAWINGS

FIG. 1 illustrates an embodiment of the new garment decoration on a jacket.

FIG. 2 is an enlarged, isolated illustration of the border portion of the garment decoration shown in FIG. 1.

DETAILED DESCRIPTION OF THE DRAWINGS

Figure 3:
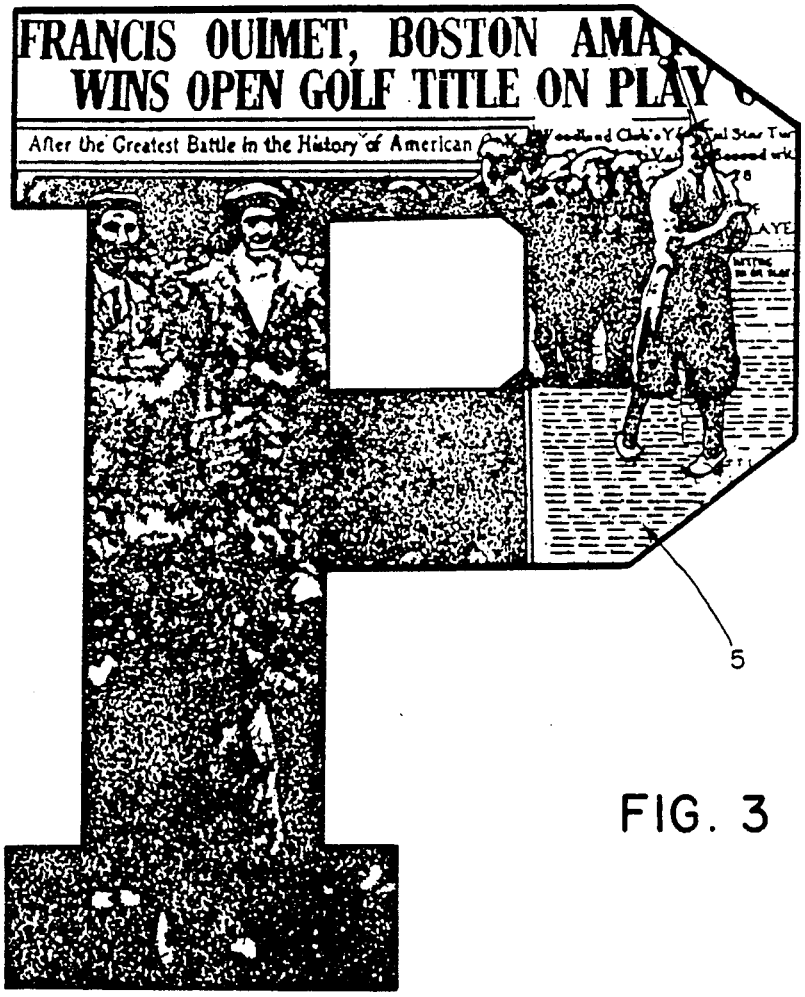
FIG. 3 is an enlarged, isolated illustration of the interior portion of the garment design shown in FIG. 1.

FIG. 1 illustrates an embodiment of the new garment decoration generally indicated by the numeral 1. The overall decoration is a letter "P" in block letter form. The decoration is applied to a high school letter jacket 7. An interior image portion 5 containing an image is applied to the jacket in the block letter P-shape, and a chenille trim 3 borders the image, highlighting the letter "P" shape of the decoration.

FIG. 2 provides an enlarged, isolated view of the chenille portion 3 of a P-shaped decoration. The plain area bordered by the chenille 3 would be the image area 5. In this embodiment, the chenille borders all edges of the letter "P". The chenille may be one or more colors. The chenille may also be patterned, such as one color of chenille bordering another color of chenille.

FIG. 3 shows an enlarged, isolated view of the image area 5 of the decoration embodiment of FIG. 1. The image area 5 is in the shape of a block letter "P". The image is of a newspaper article about a historic moment in American golf. This image would be applied directly to a garment, such as by silk-screening, and would then be bordered by chenille.

Figure 4:
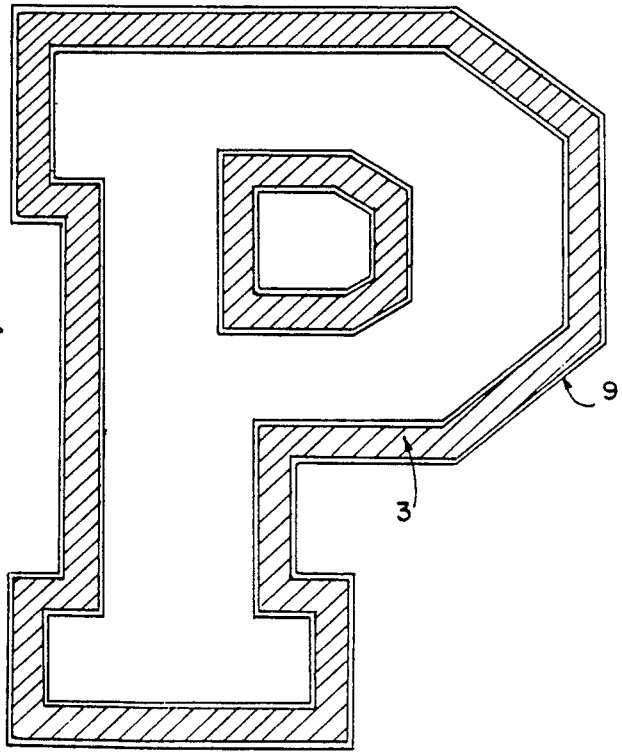
FIG. 4 is an isolated view of an optional border portion.

FIG. 4 is an isolated view of another embodiment of the outline or border of the garment decoration. The chenille portion 3 has been first sewn onto a felt base 9. The felt base has then been cut into the outline shape. In this embodiment, two separate pieces are cut out of the felt base to form the "P" shaped outline. The felt base 9 leaves a slight trim about thechenille portion 3.

While the invention has been described with reference to specific embodiments, modifications and variations of the invention may be constructed without departing from the scope of the invention, which is described in the following claims.

I claim:

1. A decorative shape comprising:

an interior area comprising an image manufactured upon an isolated area of a base fabric body which contains no chenille, and, an outline area substantially comprising chenille affixed to the base fabric body.

2. The decorative shape of claim 1, comprising an alphanumeric shape, symbol or character.

3. The decorative shape of claim 1, wherein the image comprises a silk-screened image.

4. The decorative shape of claim 1, wherein the outline area comprises a plurality of colors of chenille.

5. The decorative shape of claim 1, wherein the outline area comprises one color of chenille bordering another color of chenille.

6. The decorative shape of claim 1, wherein the outline area comprises a chenille outline on a felt base outline.

7. A method of creating and applying a garment decoration comprising:

manufacturing a garment;

manufacturing an image upon an isolated area of a base fabric body of the garment containing no chenille to produce an interior area of decoration;

chenilling directly onto the base fabric of the garment to produce an outline area of the decoration.

8. The method of claim 7, in which manufacturing an image on a garment comprises silk-screening an image onto a garment.

9. The method of claim 7, in which manufacturing an image on a garment comprises heat-seal transferring an image.

10. The method of claim 7, wherein chenilling directly onto a garment comprises creating an outline pattern with more than one color of chenille.

11. The method of claim 7, wherein the chenilling comprises brodering one color of chenille with another color of chenille.

12. A decorated outer wear garment, comprising a fabric body with hems, openings and closures for outer wear, a decorative image printed in an isolated area on the fabric of the body, and a chenille border fixed to the body about the isolated area containing the design image.

13. The apparatus of claim 12, wherein the design image is a printed multi-part image.

14. The apparatus of claim 13, wherein the chenille border is sewn into the fabric of the body of the garment as an outline for the image.

* * * * *